US006165286A

United States Patent [19]

Bayer et al.

[11] Patent Number: 6,165,286

[45] Date of Patent: Dec. 26, 2000

[54] DIFFUSION HEAT TREATED THERMALLY SPRAYED COATINGS

[75] Inventors: George T. Bayer, Tarentum, Pa.; Kim A. Wynns, Spring, Tex.

[73] Assignee: Alon, Inc., Leechburg, Pa.

[21] Appl. No.: 09/305,551

[22] Filed: May 5, 1999

[51] Int. Cl.[7] ..... C22F 1/04

[52] U.S. Cl. ..... 148/220; 148/285; 148/531; 148/535

[58] Field of Search ..... 148/217, 220, 148/285, 519, 529, 531, 535

[56] References Cited

U.S. PATENT DOCUMENTS

| | | | |
|---|---|---|---|
| 2,988,807 | 6/1961 | Boggs | 148/535 |
| 3,400,010 | 9/1968 | Keating | 148/531 |
| 4,031,274 | 6/1977 | Bessen | 148/535 |
| 4,364,780 | 12/1982 | Blanken | 148/285 |

FOREIGN PATENT DOCUMENTS

| | | | |
|---|---|---|---|
| 3-150343 | 6/1991 | Japan | 148/285 |

OTHER PUBLICATIONS

*ASM Handbook*, vol. 4, "Heat Treating", pp 542–544, ASM, 1991.

*ASM Handbook*, vol. 5, "Surface Engineering", pp. 55–66, ASM, 1994.

"Guide for the Protection of Steel with Thermal Sprayed Coatings of Aluminum and Their Alloys and Composites," American Welding Society, 1993.

"Corrosion Tests Of Flame–Sprayed Coated Steel—19–Year Report." American Welding Society, 1973.

*Primary Examiner*—George Wyszomierski

*Attorney, Agent, or Firm*—Buchanan Ingersoll, P.C.

[57] ABSTRACT

A method of aluminum diffusion coating the surface of an iron-, nickel-, cobalt-, or titanium-base alloy product begins with cleaning and providing an anchor profile on the surface of the product, followed by depositing with an appropriate thermal spray method at least 4 mils (0.1016 millimeters) thickness of a minimum 85 wt. % aluminum alloy, which can also contain up to 12 wt. % silicon. A MCrAlX-type coating layer is also thermally sprayed on the substrate surface before the aluminum alloy is sprayed. The thermal sprayed products are heat treated in a sealed retort at a temperature of between 900° F. and 1200° F. (482° C. and 649° C.) and then maintained at that temperature for a period of at least one hour to ensure the formation of a strong metallurgical bond between the aluminum alloy layer and the product. The retort temperature is then elevated to between 1400° F. and 2000° F. (760° C. and 1093° C.) and held at that temperature for between 0.17 hour (10 minutes) and 7 hours to cause the diffusion of the aluminum alloy surface layer and subsequent formation of an aluminum diffusion coating. A further treatment step after diffusion heat treatment can be conducted to form a surface oxide, nitride, or combination surface layer. Abrasive blasting of the finished aluminum diffusion coated product may be done to remove any residual aluminum alloy overlay remaining on the coating surface and to provide an improved surface finish and appearance.

11 Claims, 1 Drawing Sheet

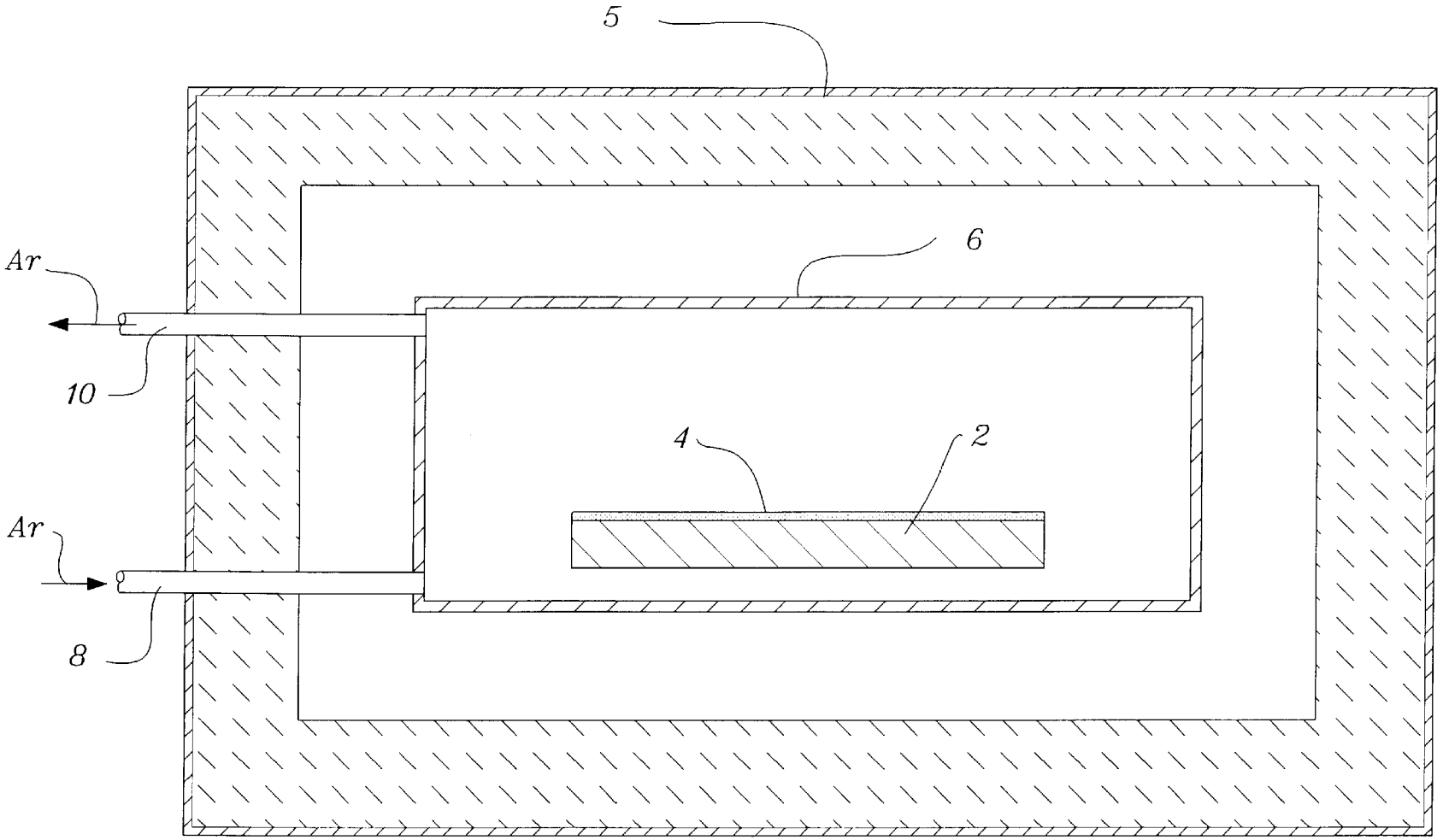
5
6
2
4
Ar
10
Ar
8

DIFFUSION HEAT TREATED THERMALLY SPRAYED COATINGS

FIELD OF INVENTION

The invention relates to a single or multiple application of thermally sprayed coatings of selected metals onto iron-, nickel-, cobalt-, and titanium-base materials to provide a corrosion resistant surface.

BACKGROUND OF THE INVENTION

Plain carbon steel and low alloys used in corrosive environments can be susceptible to corrosion by the reduction or oxidation process because the naturally occurring protective oxide layer is not sufficient to maintain stability. Even the higher alloys such as nickel-, cobalt-, and titanium-base alloys exhibit limits in certain environments. There are many methods to modify the surface of carbon steels and low alloys by aluminizing the surface with thermal spray of aluminum or a higher alloy such as austenitic stainless steel. Thermal sprays in some cases provide the necessary protection and life extension designed into the part, as is described in detail in the American Welding Society report AWS C2.14–74. "Corrosion Tests of Flame-Sprayed Coated Steel, 19-Year Report." However, thermal sprays are only coatings mechanically bonded to the surface and can be removed by permeation of corrosion gases, thus separating the coating from the base material. Another form of failure which thermal sprayed coatings undergo is differential thermal expansion between the base material and the coating.

CVD (chemical vapor deposition) and PVD (physical vapor deposition) are delivery systems that can transfer corrosion resistant metal vapors to the surface of the base material. CVD and PVD both are limited to smaller processing sizes and cost effective logistics. There is a need for a method that allows for large surface areas to be thermally sprayed with a diffusable corrosion resistant metal without disbonding of the thermally sprayed coating or melting and run-off of the thermally sprayed coating. The method should provide for use of a cost effective iron-, nickel-, cobalt-, or titanium-base material with a corrosion resistant alloy surface.

The method should not be limited to flat components, but be useful to treat angular and rounded parts, irrespective to part geometry that can be thermally sprayed.

SUMMARY OF THE INVENTION

We provide a method of diffusing metal sprayed coatings to all surfaces of an alloy product which are physically capable of receiving metal thermal sprays whether of simple geometry or complex surfaces such as angles, inner surfaces of piping, water wall panels, and sheets of metal. We have defined optimal surface preparation via abrasive blasting or other means to which the aluminum or aluminum-silicon alloy metal thermal spray is applied. The surface of the iron-, nickel-, cobalt-, or titanium-base metal is given a cleaning to remove all diffusion barriers such as paint, coatings, dirt, debris, and hydrocarbons; and then is provided an anchor profile abrasive blast ranging from 0.5 mils (0.0254 millimeter) to 6.0 mils (0.1524 millimeter). The coating is then sprayed onto the base material using the most economical method of thermal spray such as combustion arc, electric twin wire arc, HVOF, or plasma spray. Oxyacetylene is not considered an optimal method for the application of the metal coating to the substrate because it produces higher porosity and higher oxide inclusion content coatings. The metal thermally sprayed is usually applied in multiple passes to produce one layer. A single layer of aluminum or aluminum-silicon is usually all that is needed. Multiple layers of aluminum, aluminum-silicon, and MCrAlX (wherein M=iron, nickel, cobalt and X=rare earth element) are also used. We provide a four step heat treatment cycle that stabilizes the metal coating, holding it in place, while the kinetics of the heat treatment can allow for solid state diffusion of corrosion resistant elements. The heat treatment cycle is unique for each iron-, nickel-, cobalt-, or titanium-base material, requiring (1) special heat up rate, (2) intermediate hold temperature based on thermal spray coating composition, (3) final heat up rate and (4) final hold temperature and time. After the diffusion heat treatment process is completed, the surface may be otherwise treated based upon the intended use of the coated metal product. Some thermally sprayed coatings will contain rare earth elements that form stable oxides on the surface such as yttrium or zirconium.

BRIEF DESCRIPTION OF THE FIGURE

The FIGURE is a cross sectional schematic of a coated part in a retort which has been placed in a furnace for diffusion heat treatment.

DESCRIPTION OF THE PREFERRED EMBODIMENTS

We provide a unique method for diffusion coatings products, particularly iron-, nickel-, cobalt-, and titanium-based alloy products, which can coat large surface area parts and parts with complex geometry. This coating process includes surface preparation before the application of thermal spray coating, the application of the thermal spray coating(s), a heat treatment cycle to hold the thermal spray coating(s) in place while diffusing into the part, and, if desired, the treatment of the final diffusion coating surface to further enhance oxidation resistance or improve appearance.

First, the surface of the target part is cleaned. The cleaning step is necessary to remove any diffusion barrier such as paints, coatings, oxides, nitrides, debris, salts, or hydrocarbons. An anchor profile is then mechanically applied to the surface, usually with abrasive blast. The anchor profile is usually between 0.5 mils (0.0127 millimeters) and 6.0 mils (0.1524 millimeters) as confirmed by surface comparator, and serves to provide adequate initial profile for the thermal spray to mechanically bond sufficiently to undergo the subsequent diffusion heat treatment. Before surface oxidation or rust can form on the surface of the part, a coating of aluminum or aluminum-silicon alloy is thermally sprayed onto the surface. The thermal spray method can be combustion arc, electric wire arc, high-velocity oxyfuel HVOF, or plasma. Oxyacetylene method of thermal spray is not recommended, although it can be used. Oxyacetylene results in a coating high in porosity and high in oxide inclusion content which is usually undesirable. The thermal spray coating of aluminum or aluminum-silicon alloy is applied in thickness from 4 mils (0.1016 millimeters), preferably up to 15 mils (0.3810 millimeters). We have found that deposition less than 4 mils (0.1016 millimeters) results in a nonuniform diffusion coating, which is unacceptable. We have also found that the optimum thickness of coating deposited within this range will vary based on the type of base material being processed. Specific standards of surface preparation and spraying are described in the American Welding Society publication ANSI/AWS C2.18–93 "Guide for the Protection of Steel with Thermal Sprayed Coatings of Aluminum and Zinc and their Alloys and Composites." Also, additional technical detail concerning thermal spray processes in general are provided in the book *Thermal Spraying: Practice, Theory, and Application,* (American Welding Society, 1985).

As shown in the FIGURE, a part 2 having a thermal spray coating 4 is then inserted into a retort 6. The retort is placed in furnace 5. Argon is injected into the retort to provide a controlled environment. We heat the part in the retort to achieve the special meniscus soak temperature. This meniscus wetting or soak temperature usually ranges from 900° F. (482° C.) to 1200° F. (649° C.), depending on the composition of the thermally sprayed coating. The part is held at this stabilizing temperature to form the proper meniscus tension that will enable the thermal spray coating to remain on the part and be free from melting and running off the part. Argon is continuously injected into the retort 6 through input pipe 8. The retort is vented through ventpipe 10. Even with an argon purge, a low oxygen partial pressure allows a surface oxide to form on the top of the thermal spray coating, further supporting the surface tension. Once this meniscus tension is formed, the part is heated further to the diffusion temperature at a rate so as not to disturb the meniscus tension developed at the intermediate hold temperature. The ramp up heating rate to the final hold temperature is again controlled and the retort environment is maintained with an inert argon gas purge, keeping out excess deleterious oxygen or air. The final diffusion temperature is in the range of 1400° F. (760° C.) to 2000° F. (1093° C.), and the final hold time ranges between 0.17 hour (10 minutes) and 7 hours, depending on the thermal spray coating composition, base metal composition, and required diffusion thickness. The process yields an aluminum or aluminum-silicon diffusion coating ranging in thickness from 2–5 mils (0.0508–0.1270 millimeter) on nickel- and cobalt-base alloys, up to 10 mils (0.2540 millimeter) on titanium-base alloys, and up to 20 mils (0.5080 millimeter) on iron-base alloys.

After the diffusion coating is completed, then the part can be treated with the introduction of hydrogen to prepare the surface for the treatment process. Once the surface has been cleaned with high temperature hydrogen by sweeping past the part at an elevated hold temperature, then argon, nitrogen, helium and/or oxygen can be introduced into the retort. The part is held for a sufficient time and temperature to convert the coating surface to the preferred surface oxide, nitride, or combination thereof for improved resistance to corrosion, oxidation, sulfidation, carburization, surface reactions, coking, and fouling. As an alternative to this treatment process, an abrasive blast of the coated surface may be performed simply to remove any residual aluminum overlay and improve surface finish and appearance.

The coated parts can be welded. Welding together of the parts after diffusion coating is preferably accomplished using special bevel preparation and typical weld wire and purge techniques historically used for diffusion coated part fabrication. Welding procedures are described by the applicants Bayer and Wynns in the article "Welding of Diffusion Aluminized Alloys," in the American Welding Society publication AWS Welding Handbook, 8th Edition, Volume 4, Chapter on Coated Steels.

We have used this method to aluminum diffusion coat utility boiler waterwall panels for the power generation industry, tubes for waste heat exchangers, sulfur recovery boilers, ethylene furnace tubes, metal sheets for the refinery industry, and by-pass liners for the chemical industry. However, the method is not limited to these applications.

Our method provides a much more uniform diffusion coating on large size components than can be achieved using pack cementation processes. Since the thermally sprayed coating metal diffuses into the base metal, the coating has become part of the base metal. In consequence, it will not flake or spall like a conventional thermal spray coating can.

EXAMPLE 1

Diffusion heat treatment studies were conducted on AISI 1018 carbon steel, type 304 stainless steel, type 347 stainless steel, and alloy 800 coupons. The coupons were all 99% aluminum electric arc wire sprayed with an aluminum deposit thickness of 4 mils (0.1016 millimeter) except in the case of the type 347 stainless steel coupons, some of which were sprayed with a deposit thickness of 2 mils (0.0508 millimeter). The final hold temperature was either 1800° F. (982° C.) or 1900° F. (1038° C.), ±20° F. (±11° C.), and the time at the final hold temperature was either 2 hours or 3 hours.

The sprayed coupons were placed in welded carbon steel boxes (retorts) equipped with an argon purge, thermowell/thermocouple, and ventpipe. These retorts were loaded into a two-burner gas fired furnace. An initial argon purge was conducted to displace air from the retort. Argon flow was continued, and the retort was heated to a temperature of 1075° F. (580° C.), ±20° F. (±11° C.), and held at this temperature for 2 hours. The furnace temperature was then increased to heat the retort to either 1800° F. (982° C.) or 1900° F. (1038° C.), ±20 F. (±11° C.), as described above, and held for either 2 or 3 hours. After the hold was completed, the furnace was shut down and the retort and coupons were allowed to cool to room temperature under flowing argon before the coupons were removed from the retort.

Metallographic cross-sections of the coupons were prepared using standard cutting, mounting, grinding, and polishing techniques. An optical metallograph (microscope) was used to determine the aluminum diffusion zone thickness, as presented in Table 1 below.

TABLE 1

Average Diffusion Thickness for Experiments Using Pure Aluminum Arc-Wire Spray/Diffusion Heat Treatment

| Alloy Coupon | Spray Thickness, mils (mm) | Final Hold Temperature ° F. (° C.) | Final Hold Time (hours) | Diffusion Thickness, mils (mm) |
|---|---|---|---|---|
| 1018 Carbon Steel (0 Cr., 0 Ni.) | | | | |
| Sample 1 | 4 (0.1016) | 1800 (982) | 3 | 8.5 (0.2159) |
| Sample 2 | 4 (0.1016) | 1900 (1038) | 2 | 8.5 (0.2159) |
| Sample 3 | 4 (0.1016) | 1900 (1038) | 3 | 11.0 (0.2794) |
| Type 304 Stainless (18 Cr., 10 Ni) | | | | |
| Sample 1 | 4 (0.1016) | 1800 (982) | 3 | 10.0 (0.2540) |
| Sample 2 | 4 (0.1016) | 1900 (1038) | 2 | 10.0 (0.2540) |
| Sample 3 | 4 (0.1016) | 1900 (1038) | 3 | 13.5 (0.3429) |
| Type 347 Stainless (18 Cr., 11 Ni) | | | | |
| Sample 1 | 2 (0.0508) | 1800 (982) | 3 | 1.5 (0.0381)* |
| Sample 2 | 2 (0.0508) | 1900 (1038) | 3 | 2.0 (0.0508)* |
| Sample 3 | 4 (0.1016) | 1800 (982) | 3 | 6.5 (0.1651) |

TABLE 1-continued

Average Diffusion Thickness for Experiments Using Pure Aluminum Arc-Wire Spray/Diffusion Heat Treatment

| Alloy Coupon | Spray Thickness, mils (mm) | Final Hold Temperature ° F. (° C.) | Final Hold Time (hours) | Diffusion Thickness, mils (mm) |
|---|---|---|---|---|
| Sample 4 | 4 (0.1016) | 1900 (1038) | 2 | 7.5 (0.1905) |
| Sample 5 | 4 (0.1016) | 1900 (1038) | 3 | 11.5 (0.2921) |
| Alloy 800 (21 Cr., 32 Ni) | | | | |
| Sample 1 | 4 (0.1016) | 1800 (982) | 3 | 5.5 (0.1397) |
| Sample 2 | 4 (0.1016) | 1900 (1038) | 2 | 5.6 (0.1422) |
| Sample 3 | 4 (0.1016) | 1900 (1038) | 3 | 5.7 (0.1448) |

*Large fraction of bare spots present.

In general, aluminum diffusion thickness increased with increasing hold temperature and increasing hold time. Aluminum diffusion thickness at a given hold temperature and hold time decreases with an increased nickel and chromium content in the alloy. It was also seen that 2 mils (0.0508 millimeter) thickness of aluminum spray did not result in a uniform diffusion coating on type 347 stainless steel, as a large fraction of bare (uncoated) spots were present. Thus, 4 mils (0.1016 millimeter) or thicker of aluminum spray are required to provide a uniform diffusion coating.

Thermal cycling experimental studies were conducted on the aluminum diffusion coating AISI 1018 carbon steel coupons. These experiments involved heating in an air atmosphere furnace from room temperature to 2000° F. (1093° C.) at a rate of 9° F. (5° C.) per minute, hold at 2000° F. (1093° C.) for two hours, and then cooling overnight by switching the furnace off. A total of 50 cycles were conducted.

The samples were weighed initially, after every 5 cycles, and at the end of the test. Weight gains and scale coloration were consistent with the formation of a protective aluminum oxide film. There was no flaking or spalling of the coating and the protective aluminum oxide film.

EXAMPLE 2

A second series of experiments was performed using commercially available 95% aluminum-5% silicon wire spray or 88% aluminum-12% silicon wire spray. A similar procedure was employed as described in Example 1, using the same furnace/retort combination and argon purge. Wire spray thickness here was in the 5 to 7 mil (0.1270 to 0.1778 millimeter) range. The alloys studied in this experiment were AISI 1018 carbon steel coupons, ASTM A192 carbon steel tubes (OD sprayed), type 304 stainless steel tubes (OD sprayed), type 316 stainless steel coupons, alloy 800 coupons, and alloy 600 coupons. Three heat treating cycles were employed, each with the same intermediate hold at 1000° F. (538° C.), ±20° F. (±11° C.) for 2 hours:

1. 1400° F. (760° C.), ±20° F. (±11° C.), hold for 5 hours.
2. 1800° F. (982° C.), ±20° F. (±11° C.), hold for 1 hour.
3. 1900° F. (1038° C.), ±20° F. (±11° C.), hold for 10 minutes.

Optical metallography was also performed on each of the samples in a fashion similar to that described in Example 1. Table 2 provides diffusion thickness for the 95% aluminum-5% silicon wire spray/heat treated samples, and Table 3 provides diffusion thickness for the 88% aluminum-12% silicon wire spray/heat treated samples.

TABLE 2

Average Diffusion Thickness in Mils (Millimeters) for 95% Aluminum - 5% Silicon Arc Wire Spray/Diffusion Heat Treated Samples

| Alloy | 1400° F. (760° C.)/5 hours (Sample 1) | 1800° F. (982° C.)/1 hour (Sample 2) | 1900° F.(1038° C.)/ 10 min. (Sample 3) |
|---|---|---|---|
| 1018 Carbon Steel (0 Cr., 0 Ni.) | n/a* | 6.0 mils (0.1524 mm) | 7.0 mils (0.1778 mm) |
| A192 Carbon Steel (0 Cr., 0 Ni.) | 13.5 mils (0.3429 mm) | 12.0 mils (0.3048 mm) | n/a |
| 304 Stainless Steel (18 Cr., 10 Ni.) | 3.0 mils (0.0762 mm) | 3.0 mils (0.0762 mm) | 4.5 mils (0.1143 mm) |
| 316 Stainless Steel (17 Cr., 12 Ni.) | n/a | 3.5 mils (0.0889 mm) | 4.5 mils (0.1143 mm) |
| Alloy 800 (21 Cr., 32 Ni.) | 1.5 mils (0.0381 mm) | 1.0 mil (0.0254 mm) | n/a |
| Alloy 600 (16 Cr., 76 Ni.) | n/a | 1.0 mil (0.0254 mm) | <1.0 mil (<0.0254 mm) |

*n/a indicates that this was not tested

TABLE 3

Diffusion Thickness in Mils (Millimeters) of 88% Aluminum - 12% Silicon Arc Wire Spray/Diffusion Heat Treated Samples

| Alloy | 1400° F.(760° C.) /5 hours (Sample 1) | 1800° F.(982° C.) /1 hour (Sample 2) | 1900° F.(1038° C.)/ 10 min. (Sample 3) |
|---|---|---|---|
| 1018 Carbon Steel (0 Cr., 0 Ni) | n/a* | 7.5 mils (0.1905 mm) | 6.5 mils (0.1651 mm) |
| A192 Carbon Steel (0 Cr., 0 Ni) | No Diffusion | 7.0 mils (0.1778 mm) | n/a |
| 304 Stainless Steel (14 Cr., 9 Ni) | No Diffusion | 3.0 mils (0.0762 mm) | 5.0 mils (0.1270 mm) |
| 316 Stainless Steel (17 Cr., 12 Ni) | n/a | 4.0 mils (0.1016 mm) | 5.0 mils (0.1270 mm) |
| Alloy 800 (21 Cr., 33 Ni) | No Diffusion | 1.5 mils (0.0381 mm) | n/a |
| Alloy 600 (16 Cr., 76 Ni) | n/a | 1.5 mils (0.0381 mm) | 1.5 mils (0.0381 mm) |

*n/a indicates that this was not tested.

Similar trends are seen among the alloys in Table 1, Table 2 and Table 3 with regard to increasing diffusion thickness with decreasing nickel and chromium content in the alloy. It can also be seen that increasing the silicon content of the wire spray has the effect of making diffusion coating formation impossible at 1400° F. (760° C.). However, at higher temperatures, diffusion characteristics of the two silicon-containing aluminum alloys (95Al-5Si and 88Al-12Si) are similar.

This example also shows the feasibility of producing an aluminum diffusion coating at temperatures as low as 1400° F. (760° C.), provided that silicon content in the thermal spray aluminum alloy is no higher than 5%.

EXAMPLE 3

An aluminum diffusion coating system was studied on ASTM A178 carbon steel tubes welded together with thin carbon steel membrane sections to form a small one foot (30.48 centimeters) by two foot (60.96 centimeters) water-wall panel, as typically employed on a larger scale in coal-fired electric utility boilers. Approximately 7 to 10 mils (0.1778 to 0.2540 millimeters) of 99% aluminum was arc wire sprayed on one side of the panel. After arc wire spray coating the panel, a similar procedure was employed as used in the preceding two examples, with an argon purge and an intermediate hold temperature of 1075° F. (580° C.), ±20° F. (±11° C.), for 2 hours. A final temperature of 1900° F. (1038° C.), ±20° F. (±11° C.), was held for 3 hours.

Optical metallography of the coating-substrate cross section indicated a uniform, metallurgically bonded diffusion coating with a thickness of approximately 15 mils (0.3810 millimeters). Scanning electron microscopy/energy dispersive x-ray fluorescence spectrometry across the coating thickness revealed the aluminum concentration profile as given in Table 4. A surface concentration of 28 weight % aluminum was established at the surface of the coating, a desirable condition for improving elevated temperature corrosion resistance of steel boiler components.

TABLE 4

Aluminum Composition Profile of 99% Aluminum Arc Wire Spray/Diffusion Heat Treated Coating on A178 Carbon Steel

| Depth From Coating Surface, mils (mm) | Weight % Aluminum |
|---|---|
| 0.0 (0.0000) | 28.2 |
| 2.5 (0.0635) | 26.6 |
| 5.0 (0.1270) | 23.1 |
| 7.5 (0.1905) | 17.9 |
| 10.0 (0.2540) | 13.4 |
| 12.5 (0.3175) | 10.8 |
| 15.0 (0.3810) | 5.4 |
| 17.5 (0.4445) | 0.0 |

EXAMPLE 4

An experimental dual diffusion coating system was studied on AISI 1018 carbon steel coupons which involved electric arc wire spray deposition of the following two coatings in sequence:

1. 10 mils (0.2540 millimeter) of 74% iron-20% chromium-6% aluminum (first layer), and
2. 7 mils (0.1778 millimeter) of 99% aluminum (second layer on top of first layer).

After arc wire spray coating the coupons, a similar procedure was employed as used in the preceding three examples, with an argon purge and an intermediate hold temperature of 1075° F. (580° C.), ±20° F. (±11° C.), for 2 hours. A final temperature of 1825° F. (996° C.), ±20° F. (±11° C.), was held for 7 hours. Optical metallography of the coating-substrate cross section indicated a uniform, metallurgically bonded diffusion coating with a thickness of approximately 12 mils (0.3048 millimeter). Scanning electron microscopy/energy dispersive x-ray fluorescence spectrometry across the coating thickness revealed the elemental composition profile as given in Table 5. This combined coating system on 1018 carbon steel has a surface composition of nearly 25 wt. % aluminum and 9 wt. % chromium. Such a coating system may have important applications where the aluminum-chromium combination can provide combined oxidation, sulfidation, and hot corrosion resistance. One such application would be the fireside of water-wall panels in electric utility boilers, especially in low-NOx environments.

TABLE 5

Element Composition Profile of Sequential FeCrAl/Al Arc Wire Spray/Diffusion Heat Treated Coating

| Depth From Coating Surface, mils (mm) | Weight % Aluminum | Weight % Chromium |
|---|---|---|
| 0.0 (0.0000) | 24.8 | 8.8 |
| 1.4 (0.0356) | 24.0 | 8.4 |
| 2.8 (0.0711) | 24.3 | 4.5 |
| 4.2 (0.1067) | 20.8 | 3.1 |
| 5.6 (0.1422) | 16.4 | 2.0 |
| 7.0 (0.1778) | 13.2 | 0.9 |
| 8.4 (0.2134) | 10.1 | 0.4 |
| 9.8 (0.2489) | 4.6 | 0.3 |
| 11.2 (0.2845) | 0.6 | 0.3 |
| 12.6 (0.3200) | 0.2 | 0.2 |

EXAMPLE 5

An experimental series was attempted to produce an aluminum diffusion coating on a titanium-5% vanadium-4% aluminum alloy by pure aluminum arc-wire spray/diffusion heat treatment in air. An aluminum deposition thickness of 5 to 7 mils (0.1270 to 0.1778 millimeter) was used. The experimental setup was similar to that employed in previous series. The following heat treatment cycles were employed, after first holding at an intermediate temperature of 1075° F. (580° C.), ±20° F. (±11° C.), for 2 hours:

1. 1750° F. (954° C.), ±20° F. (±11° C.), for 4. hours.
2. 1850° F. (1010° C.), ±20° F. (±11° C.), for 12 hours.
3. 2100° F. (1149° C.), ±20° F. (±11° C.), for 24 hours.

Optical metallographic cross section of the heat treated samples was conducted. It was found that the 1750° F. (954° C.)/4 hour sample had an average aluminum diffusion thickness of 8 mils (0.2032 millimeter). The 1850° F. (1010° C.)/12 hour sample had an average aluminum diffusion thickness of 10 mils (0.2540 millimeter). The 2100° F. (1149° C.)/24 hour sample suffered a breakdown of the aluminum diffusion coating. Thus, a satisfactory and uniform aluminum diffusion coating could be formed over the temperature range 1750° F.–1850° F. (954° C.–1010° C.).

While we have described and illustrated certain preferred embodiments for aluminum-based diffusion coating on iron-, nickel-, cobalt-, and titanium-based alloy products using a thermal spray/diffusion heat treatment process, it should be distinctly understood that our invention is not limited thereto, but may be variously embodied within the scope of the following claims.

We claim:

1. A method of diffusion coating the surface of an alloy product with an aluminum alloy surface layer comprising:

a. preparing the surface of the alloy product to be coated by removing any diffusion barriers present on the surface and then providing a surface anchor profile to anchor the aluminum alloy surface layer;

b. applying a thermally sprayed layer of MCrAlX alloy onto the surface of the alloy product, wherein M is iron, nickel or cobalt and X is a rare earth element;

c. depositing onto the surface of the thermally sprayed layer of MCrAlX alloy a thermally sprayed aluminum alloy to create a surface layer having a thickness of at least 4 mils on a thermal sprayed product;

d. loading the thermal sprayed product into a sealed retort and placing the sealed retort into a furnace;

e. heating the retort in the furnace to a selected temperature of between 900° F. and 1200° F. (482° C. and 649° C.) and then maintaining the retort at the selected temperature for a period of at least one hour to ensure the formation of a strong metallurgical bond between the aluminum alloy layer and the product; and f. heating the retort in the furnace to a second selected temperature of from 1400° F. to 2000° F. (760° C. to 1093° C.) and then maintaining the retort at the second selected temperature for a sufficient period of time to cause diffusion of the thermally sprayed aluminum alloy surface layer and subsequent formation of an aluminum diffusion coating.

2. The method of claim 1 wherein the alloy product to be diffusion coated is selected from the group consisting of iron-base, nickel-base, cobalt-base and titanium-base alloys.

3. The method of claim 1 wherein the thermally sprayed aluminum alloy is deposited by a thermal spray method selected from the group consisting of electric twin wire arc, combustion arc, high-velocity oxyfuel, and plasma spray.

4. The method of claim 1 wherein the thermally sprayed aluminum alloy contains at least 85 wt. % aluminum.

5. The method of claim 1 wherein the thermally sprayed aluminum alloy contains up to 12 wt. % silicon.

6. The method of claim 1 also comprising supplying an inert argon purge gas flow to the sealed retort during the heating steps.

7. The method of claim 1 wherein the retort is held at the second selected temperature for a period of 0.17 hours to 7 hours.

8. The method of claim 1 also comprising treating the aluminum diffusion coating by hydrogen and then by at least one gas selected from the group consisting of argon, nitrogen, helium, and oxygen to form a layer containing at least one of aluminum oxide and aluminum nitride.

9. The method of claim 1 also comprising abrasive blasting the finished aluminum diffusion coated product.

10. The method of claim 1 wherein the surface profile is formed by abrasive blasting.

11. The method of claim 1 wherein preparing the surface of the alloy product removes at least one diffusion barrier selected from the group consisting of debris, dirt, paint, hydrocarbons, salts, oxides and nitrides.

* * * * *